US008375667B2

(12) United States Patent
Hohmann, Jr.

(10) Patent No.: US 8,375,667 B2
(45) Date of Patent: Feb. 19, 2013

(54) RUBBLE STONE ANCHORING SYSTEM

(75) Inventor: Ronald P. Hohmann, Jr., Hauppauge, NY (US)

(73) Assignee: MiTek Holdings, Inc., Wilmington, DE (US)

( * ) Notice: Subject to any disclaimer, the term of this patent is extended or adjusted under 35 U.S.C. 154(b) by 348 days.

(21) Appl. No.: 12/640,128

(22) Filed: Dec. 17, 2009

(65) Prior Publication Data

US 2011/0146195 A1 Jun. 23, 2011

(51) Int. Cl.
*E04B 1/16* (2006.01)

(52) U.S. Cl. ..... 52/379; 52/383; 52/565; 52/712

(58) Field of Classification Search ..... 52/378, 52/379, 380, 383, 565, 568, 712, 713, 508, 52/509, 513, 434, 474
See application file for complete search history.

(56) References Cited

U.S. PATENT DOCUMENTS 1,946,732 A * 2/1934 Danielson ..... 52/428
4,373,314 A * 2/1983 Allan ..... 52/434
4,596,102 A 6/1986 Catani et al.
4,765,112 A 8/1988 Lafayette, Jr.
6,279,283 B1 * 8/2001 Hohmann et al. ..... 52/379
6,351,922 B1 * 3/2002 Burns et al. ..... 52/713
6,668,505 B1 * 12/2003 Hohmann et al. ..... 52/565
6,719,487 B2 4/2004 Yukimoto et al.
6,789,365 B1 * 9/2004 Hohmann et al. ..... 52/565
7,325,366 B1 * 2/2008 Hohmann et al. ..... 52/513
7,469,511 B2 12/2008 Wobber

OTHER PUBLICATIONS

Fero Corporation, Rubble Masonry Veneer Support, www.ferocorp.com, 4 pgs., Nov. 4, 2009, Edmonton, Alberta.
Dayton Superior, Random/Rubble Stone System, www.dur-opwal.com, 1 pg., Nov. 4, 2009, Dayton, Ohio.

* cited by examiner

*Primary Examiner* — Jessica Laux
(74) *Attorney, Agent, or Firm* — Senniger Powers LLP

(57) ABSTRACT

Anchoring systems for use in cavity wall structures having an inner wythe and an outer wythe constructed of rubble stone are disclosed. The anchoring system employs an anchor fastened to or set within the inner wythe that extends into the cavity and connects to a J-hook. A vertically adjustable veneer tie enwraps the J-hook, limiting lateral movement and front-to-back displacement, and is set within the bed joint of the outer wythe. The anchoring system minimizes cavity size and provides stability for an uncoursed outer wythe equivalent to that of anchoring systems for standards coursed bed joints.

16 Claims, 7 Drawing Sheets

RUBBLE STONE ANCHORING SYSTEM

BACKGROUND OF THE INVENTION

1. Field of the Invention

This invention relates to an anchoring system for cavity walls having an outer wythe of rubble stone. More particularly, the invention relates to an anchoring system that adjusts to the irregular surface structure and uneven nature of irregular rubble stone courses.

2. Description of the Prior Art

Masonry is a highly durable form of construction. However, the materials used, the quality of the mortar and workmanship, and the pattern utilized in the assembly of the units strongly affect the aesthetics and durability of the overall masonry construct. The appearance of a rubble stone outer wythe imparts an impression of solidity and permanence, adding to the aesthetic value of a building. The use of rubble stone increases the thermal mass of a building, giving increased comfort in the heat of summer and the cold of winter.

Common rubble stone walls have been built since the beginning of ancient civilizations. Early rubble stone walls were constructed by the first builders and likely the Egyptians built rubble stone walls from the pieces left over from forming the giant pyramid stones. Because rubble stones are rough and irregular fragments of broken stone formed by a geological or quarrying process, they are plentiful and considered to be a common stone. Rubble stones are generally less expensive than hand formed, split or cut stone. Rubble stone is aesthetically pleasing especially when a rough, earthy appearance is desired. Some common uses for rubble stone are retaining walls, garden walls, house walls, landscaping and fireplaces.

Among the American architectural uses of rubble stone walls is that of the use of rubble stone building exteriors of the Arts and Crafts movement. This is seen especially in the work of the Greene brothers in Pasadena, Calif. in the early 1900's. As the popularity of rubble stone exteriors in commercial buildings grows, building code compliant methods of anchoring the rubble stones to an inner wythe are needed. The present invention solves the technical issues relating to rubble stone outer wythes, through a novel anchoring system that limits veneer tie lateral movement and front-to-back displacement.

While rubble stone outer wythes exert extraordinary compressive strength (vertical loads) the tensile strength (twisting or stretching) thereof needs the enhancement of a well-designed anchoring and reinforcement system. Typically the anchoring system spans the cavity between the rubble stone veneer, tying the veneer to the structural inner wythe generally composed of concrete masonry units, steel columns or poured concrete. Most insulated buildings that utilize cavity wall construction feature insulation set within the cavity, as well as a drainage system.

Rubble stone used in masonry veneer are either "dressed" or "rough." Stone masonry utilizing dressed stones is known as ashlar masonry, whereas masonry using irregularly shaped stones is known as rubble masonry. Both rubble and ashlar masonry can be laid in courses (rows of even height) through the careful selection or cutting of stones. However, most rubble stone masonry is uncoursed and rough with unhewn building stone set in mortar, but not laid in regular courses.

When specific masonry veneers face high lateral loads, such as wind and seismic forces. The masonry veneer must be "tied" back to a structural inner wythe so as to carry the imposed loads. The masonry veneer must be continuously supported at regular vertical and horizontal intervals with masonry anchors because without continuous support, the masonry veneer may become over stressed, leading to vertical cracking and possible fracture. To address these issues, outer wythe wire reinforcements and tie backs are incorporated into the irregular mortar joints of the outer wythe to reinforce, bond and control shrinkage cracking.

The uneven nature of uncoursed rubble stone outer wythes presents a unique set of difficulties with regard to reinforcement and tie backs. The wire reinforcements and anchors that do not provide a high degree of adjustability to conform to the uneven nature of the rubble stone are not effective in securing a rubble stone outer wythe. Vertically adjustable ties with limited lateral movement and front-to-back displacement are required to address the problem of when the rubble stone mortar joints do not align with the inner wythe anchors.

n the past, anchoring random or rubble stone walls generally involved some form of penetration of the individual stones with an anchor. Such prior art is described in U.S. Pat. No. 6,719,487—Yukimoto et al.—Issued Apr. 13, 2004, entitled "Structural Unit for Construction, Construction of Said Structural Units, and Method for the Preparation of Said Structural Units and Said Construction," which describes an anchor for the construction of a revetment, retaining wall or the like, and U.S. Pat. No. 4,765,112—Lafayette, Jr.—Issued Aug. 23, 1988, entitled "Apparatus and Method for Mounting Stone Siding," which describes a mounting system for natural stone curtain walls. The individual penetration of the stone is time consuming and labor and materials intensive.

Further advancements in the prior art concern the use of masonry rubble or random stone walls as the outer wythe of a cavity wall structure. Such advancement resulted in the development of the Dur-O-Wall Random Rubble/Stone System that utilizes a combination of three parts, truss or ladder reinforcements with welded triangular tabs, J-bars, and triangular ties. The Dur-O-Wall disclosure requires a large cavity space to house the ties and does not restrict veneer tie lateral movement or front-to-back displacement. Another variation of a rubble masonry veneer support system is Fero Corporation's system that employs an anchor with a longitudinally extended slotted extension for use with a flanged tie. The Fero system does not provide full vertical adjustability and requires a large anchoring unit. The present invention addresses the shortcomings of the Fero and Dur-O-Wall devices. The present invention limits veneer tie lateral movement and front-to-back displacement. Additionally, the Hohmann anchoring system requires less materials and labor to install, saving both time and costs.

The present inventor developed several variations of an anchor system for rubble stone outer wythes that are for use with masonry block, steel column and poured concrete inner wythes. The novel inventions include vertical hooks or J-hooks connected to surface mounted anchors or anchor extensions of ladder and truss joint reinforcements. The veneer tie is secured to the vertical hook or J-hook for insertion in the outer wythe. The veneer tie is either a flexible buckle tie or a triangular shaped tie surrounding the vertical hook or J-hook. The present invention improves on the prior art Hohmann system through the use of a novel tie that lessens the required width of the cavity and controls lateral movement and front-to-back displacement.

The inventors' patents and their assignee's product line include masonry accessories, namely, ladder and truss reinforcements, wall anchors, veneer ties, masonry flashing and related items for cavity walls. These products, which are sold under the trademarks of Lox All, DW-10X, X-seal and Flex-Flash, are manufactured by Hohmann & Barnard, Inc., Hauppauge, N.Y. 11788 ("H&B"), a unit of MiTek Industries, Inc., a Berkshire Hathaway subsidiary. The products have become widely accepted in the construction industry and the inventors have gained particular insight into the technological needs of this marketplace.

In the past, the anchoring systems for rubble stone outer wythes did not fully address the uneven nature of the uncoursed rubble stone. The present invention solves the anchoring problem related to the use of a rubble stone outer wythe by providing an anchoring system that allows vertical adjustability without significant lateral movement or front-to-back displacement. The present invention further allows for a smaller cavity to house the veneer tie.

n preparing for this application the following patents and patent applications came to the attention of the inventors and are believed to be relevant to the further discussion of the prior art:

| U.S. Pat. No. | Inventor | Issue Date |
|---|---|---|
| 7,469,511 | Wobber | Dec. 30, 2008 |
| 6,351,922 | Burns, et al. | Mar. 5, 2002 |
| 4,596,102 | Catani, et al. | Jun. 24, 1986 |
| 4,373,314 | Allan | Feb. 15, 1983 |

U.S. Pat. No. 7,469,511—Wobber—Issued Dec. 30, 2008 discloses a masonry coupling system that employs a longitudinally extended anchor having a channel body that interfaces with a key. The key is secured within the outer wythe and is vertically adjustable. The Wobber device is for use with a uniform outer wythe.

U.S. Pat. No. 6,351,922—Burns et al.—Issued Mar. 5, 2002 describes an adjustable wall tie for a cavity wall that includes a J-shaped single-ended hook that is vertically adjusted. The single-end hook is used either side up so that vertical adjustment is extended. The Burns device is for use with a coursed outer wythe.

U.S. Pat. No. 4,596,102 Catani et al.—Issued Jun. 24, 1986 discloses a cavity wall anchor and tie. The anchor comprises a channel with a slotted web for receiving a veneer tie. The anchor is adjustable translationally and pivotally as a unit, expanding the vertical adjustment capability of the tie. The adjustability of the tie is limited to the distance between the screw and the slotted web.

U.S. Pat. No. 4,373,314—Allan—Issued Feb. 15, 1983 discloses an anchor assembly having an outstanding leg with slotted holes formed therein for interconnection with a veneer tie. The veneer tie is vertically adjustable within the slotted holes. The limits of adjustability are prescribed by the ends of the two slots.

None of the above references provide the advancements in anchoring systems for cavity walls with a rubble stone outer wythe set forth herein. The present novel invention offers a multi-purpose solution by resolving issues relating to lateral loads, uneven outer wythe bed joints and vertical adjustability without significant lateral movement or front-to-back displacement. Through the use of the present novel anchoring system for rubble stone outer wythe, code requirements are met and construction costs are reduced.

The present invention provides an advancement in rubble stone reinforcement and anchoring technology by providing an anchoring system for irregular surface outer wythes that provides the same stability as an anchoring system for standard bed joints. The present anchoring system resolves past problems relating to vertical adjustability, increased cavity size, lateral movement and front-to-back displacement, while simultaneously reducing installation labor and energy costs, thereby saving time and money.

As will become clear in reviewing the disclosure which follows, the rubble stone anchoring system benefits from the recent developments described herein that leads to solving the problems of constructing an aesthetically pleasing commercial structure efficiently, from both a structural as well as a cost/time perspective.

SUMMARY OF THE INVENTION

In general terms, the anchoring systems for cavity walls with rubble stone outer wythes disclosed hereby are an integral part of the construction of a commercial cavity wall structure. The anchoring system employs an anchor fastened to the inner wythe composed of masonry units, poured concrete, steel columns or other similar building materials. The anchor has a receptor that extends into the cavity for connection to the connection bar or J-hook fitting. The elongated body of the connection bar extends into the cavity for connection with a veneer tie or a series of veneer ties. The veneer tie has an aperture at one end that enwraps the connection bar allowing vertical movement, but limiting lateral movement and front-to-back displacement and an insertion end opposite the aperture. The insertion end of the veneer tie is embedded in the bed joint of the outer wythe. The anchor receptor also serves as a second receptor to house a second elongated body which further restricts connection bar movement within the cavity. For further seismic protection, the veneer tie insertion end houses a reinforcement wire.

Another embodiment of the present anchoring system employs a wall anchor disposed within an inner wythe of brick, block, stone or similar masonry building materials. The wall anchor comprises a reinforcement device with a plurality of parallel side rods, at least one intermediate rod connecting the side rods and maintaining the parallelism of the side rods, and an extension portion contiguous with the intermediate rod. The extension portion forms a receptor that extends into the cavity for connection to the connection bar or J-hook fitting. The elongated body of the connection bar extends into the cavity for connection with a veneer tie or a series of veneer ties. The veneer tie has an aperture at one end that enwraps the connection bar allowing vertical movement, but limiting lateral movement and front-to-back displacement and an insertion end opposite the aperture. The insertion end of the veneer tie is embedded in the bed joint of the outer wythe. The extension portion also serves as a second receptor to house a second elongated body which further restricts connection bar movement within the cavity. For further seismic protection, the veneer tie insertion end houses a reinforcement wire.

The present anchoring system for rubble stone has varied applications and provides a universal solution. One such application is for use in a rubble stone cavity wall to secure an outer wythe of rubble stone to the inner wythe. The present invention provides a vertically adjustable veneer tie that restricts lateral movement and front-to-back displacement. The novel veneer tie minimizes cavity size and provides stability for an uncoursed outer wythe equivalent to that of anchoring systems for standards coursed bed joints.

OBJECTS AND FEATURES OF THE INVENTION

It is an object of the present invention to provide new and novel anchoring systems for cavity wall construction, which systems are utilizable with a random or rubble stone outer wythe.

It is another object of the present invention to provide an anchoring system for an irregular surface uncoursed outer wythe that provides the same stability as the anchoring systems for standard coursed bed joints.

It is yet another object of the present invention to provide an anchoring system that includes a wall anchor for securing within the inner wythe and an adjustable veneer tie for securing the random or rubble stone outer wythe to the wall anchor.

It is still yet another object of the present invention to provide an anchoring system that minimized cavity size.

It is another object of the present invention to provide vertical adjustability of the veneer tie while restricting veneer tie lateral movement and front-to-back displacement.

It is a feature of the present invention that the anchoring system for random or rubble stone provides a structurally sound and aesthetically pleasing outer wythe.

It is another feature of the present invention that the anchor includes a J-hook that allows for vertical adjustment of the veneer tie.

It is yet another feature of the present invention that the anchoring systems for random or rubble stone outer wythes are labor-saving and reduce costs.

Other objects and features of the invention will become apparent upon review of the drawing and the detailed description which follows.

BRIEF DESCRIPTION OF THE DRAWINGS

In the following drawing, the same parts in the various views are afforded the same reference designators.

DESCRIPTION OF THE PREFERRED EMBODIMENTS

Figure 1:
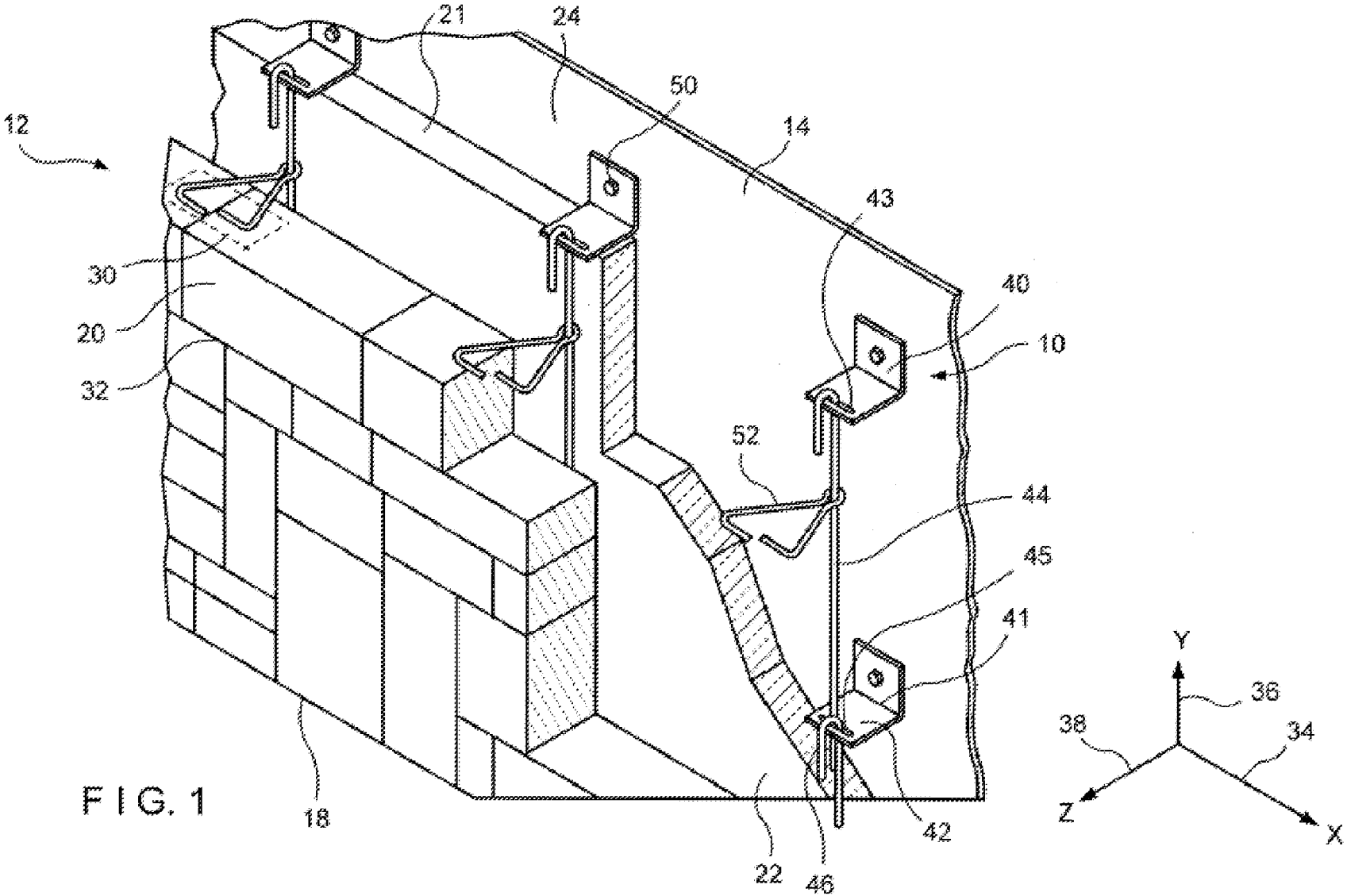
FIG. 1 shows a first embodiment of the rubble stone anchoring system of this invention and is a perspective view of the anchoring system partially constructed, fastened to an inner wythe of poured concrete with adjacent insulation and tied to an outer wythe of ashlar stone.
Figure 2:
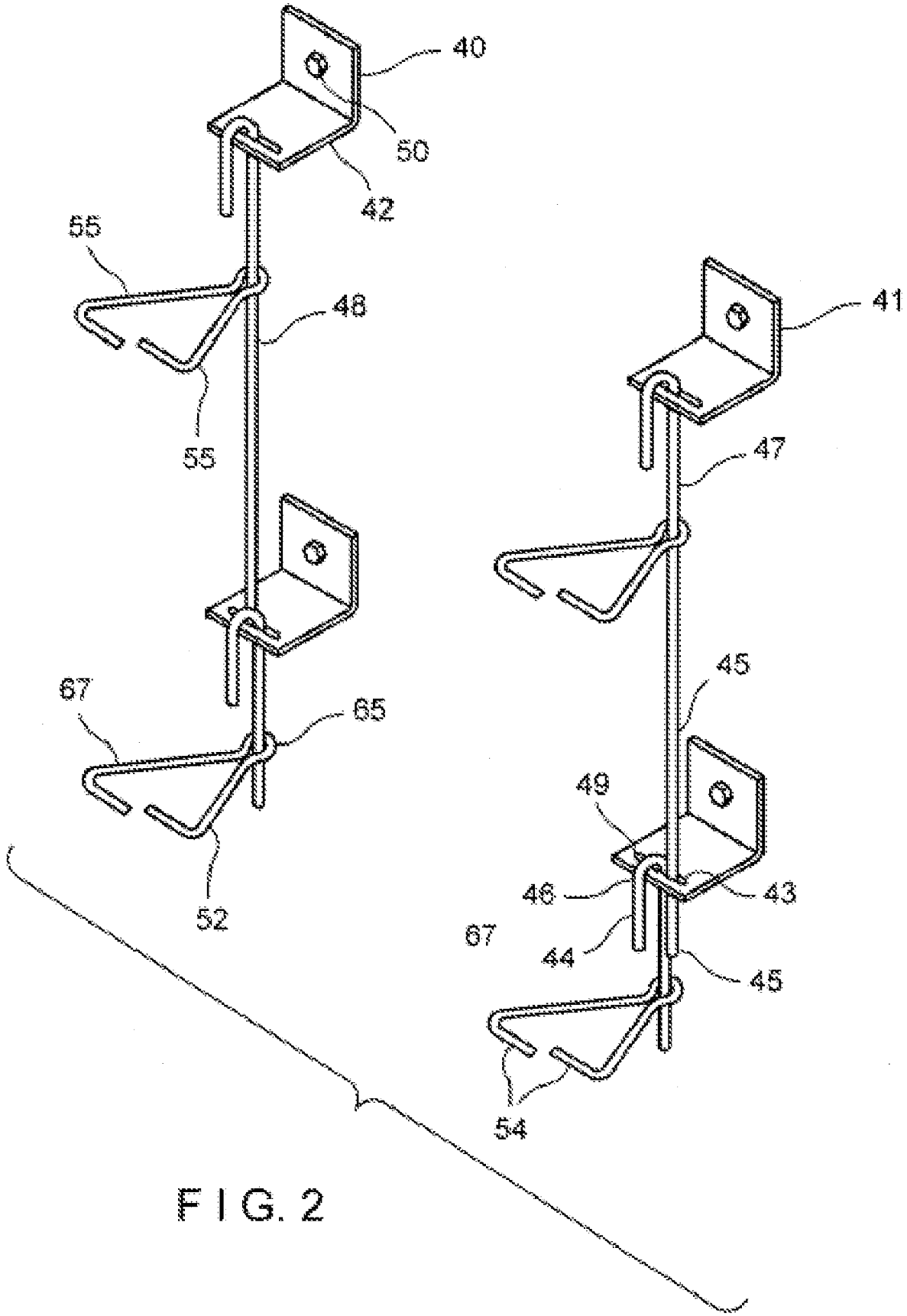
FIG. 2 is a perspective view of the uninstalled anchoring system of FIG. 1.
Figure 3:
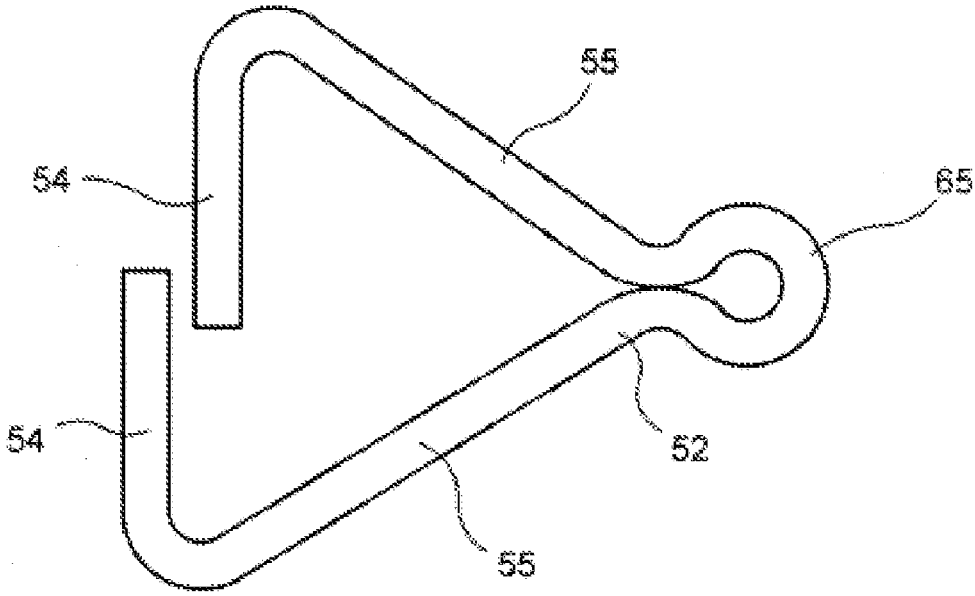
FIG. 3 is a top plan view of the veneer tie of this invention.

Rubble stone outer wythes are desirable because they are aesthetically pleasing. However, the uneven nature of the rubble stone provides many challenges. The invention hereof provides a cavity wall anchoring system for rubble stone outer wythes that provides a vertically adjustable veneer tie capable of adjusting to meet the irregular structure of rubble stone outer wythes, while providing the same stability as anchoring systems for standard bed joints. The anchoring system allows for veneer tie vertical adjustment while restricting lateral movement and back-to-back displacement, ensuring a stable tie back connection with the uneven rubble stone.

The rubble stone anchoring system described in the embodiments herein addresses issues unique to the art of anchoring irregular masonry veneers in an efficient and structurally stable manner. Unlike any other structure-supporting building materials, wall anchors are relatively small, isolated assemblies that operate individually and in concert to shoulder the burden of severe forces bearing upon massive solid-wall constructs. The construction of rubble stone veneer cavity wall structures face many challenges. Proper insulation, cavity size, and stability are examples of the challenging areas. The development of a rubble stone anchoring system is in response to these challenges. This invention resolves the structural issues related to the construction of a rubble stone outer wythe, by providing a vertically adjustable anchoring system capable of withstanding high lateral forces. This invention further reduces other costs and elements required to construct a cavity wall system.

This anchoring system, discussed in detail hereinbelow, consists of an anchor that provides a vertically adjustable method of connection with a veneer tie. The anchor and veneer tie are constructed to reduce lateral forces through the minimization of the cavity size and restriction of x- and z-axis movement. The anchoring system provides structural support equal to that provided to uniform outer wythe construction.

The present invention is in response to the prior art labor and materials intensive cavity wall construction. Construction of a cavity wall containing a rubble stone outer wythe involves careful installation of the veneer ties at appropriate levels and locations within the outer wythe. The present invention addresses the difficulties through the use of a vertically adjustable anchoring system.

Referring now to FIGS. 1 through 4, the first embodiment of the present invention shows the rubble stone anchoring system with a poured concrete inner wythe. The rubble stone anchoring system is referred to generally by the numeral 10. A cavity wall structure 12 is shown having an inner wythe 14. The inner wythe 14 is formed from poured concrete. The cavity wall 12 also includes an outer wythe 18 of ashlar rubble stone construction. The anchoring system is also for use with a random rubble stone outer wythe (not shown). Between the inner wythe 14 and the outer wythe 18, a cavity 22 is formed. The cavity 22 contains a layer of insulation 21.

For purposes of discussion, the cavity surface 24 of the inner wythe 14 contains a horizontal line or x-axis 34 and an intersecting vertical line or y-axis 36. A horizontal line or z-axis 38, normal to the xy-plane, passes through the coordinate origin formed by the intersecting x- and y-axes.

The wall anchor 40 is shown as an L-shaped structure having a base portion 41 fastened to the inner wythe 14 and a free end portion 42 contiguous with and perpendicular to the base portion 41 and extending into the cavity 22 for connection with the fitting or receiving end 46 of the J-hook 44. The free end portion 42 has a first receptor 43 for connection with the connection bar or J-hook 44. The first receptor 43 is large enough for use as a second receptor 49 to fit both the fitting end 46 of one J-hook 44 and the elongated body or connection end 45 of a second vertically planar J-hook 47. Securing both the elongated body 45 and the fitting 46 provides greater stability to the anchoring system. The wall anchor 40 is a metal stamping constructed from galvanized steel, hot dipped galvanized steel, stainless steel or bright basic steel. The wall anchor 40 is also mountable at a 90 degree angle (not shown).

The anchor 40 is fastened to the inner wythe 14 with a fastener 50 thereby creating a high-strength connection with the anchor 40 and the inner wythe 14. Although other fastening means are compatible, the fastener 50 is typically a bolt with a head and an insulative washer mounted under the bolt head. A thermal break is obtained through the use of a neoprene washer (not shown) between the fastener 50 and the inner wythe 14.

The anchoring system includes the wall anchor 40 and a veneer tie 52. The veneer tie 52, is shown in FIG. 1 as being emplaced on the ashlar rubble stone 20 in preparation for embedment in the mortar of the bed joint 30. Successive bed joints 30 and 32 are horizontally disposed in an irregular manner in accord with the nature of the rubble stone 20 and building standards and the bed joints 30 and 32 are 0.375-inch (approx.) in height.

The veneer tie 52 is a wire formative that is fixedly disposed in an x-z plane of the bed joint 30 and is constructed to adjustably position with the longitudinal axis substantially horizontal and to interengage with the wall anchor 40. The veneer tie 52 has an apertured receiving end 65 for disposition on said elongated body 45 and an insertion end 67 configured for embedment in the bed joint 30. The veneer tie 52 is constructed of front leg portions 54 configured for insertion into said bed joint 30, side leg portions 55 coextensive, perpendicular, and substantially co-planar with the front leg portions 54. The veneer tie is vertically adjustable to a substantially horizontal position and upon installation, maintains continuous positive interengagement with the wall anchor 40. For additional seismic and high-wind protection, a reinforcement wire (not shown) is embedded in the bed joint 30 and set within an optionally depressed front leg portion (not shown) for a snap-in connection.

Figure 4:
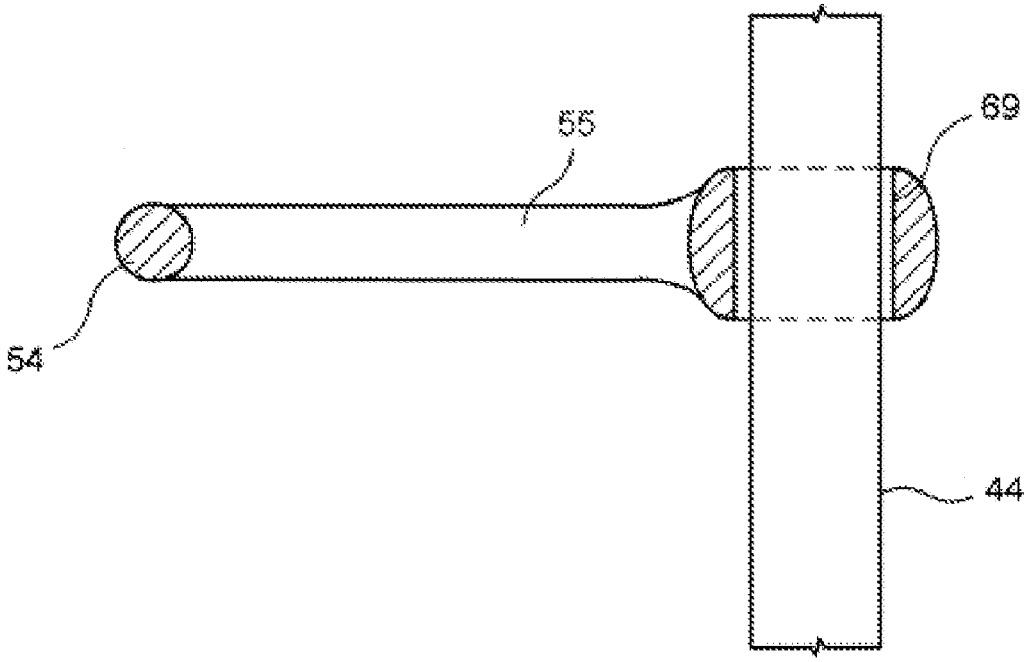
FIG. 4 is a cross-sectional view of an alternative design veneer tie of this invention showing the interior of the receiving end flattened into a D-shape.

The veneer tie receiving end 65 is formed to snugly fit around the connection end 48 of the J-hook 44. The snug fit restricts x- and z-axis movement to 0.050 inches of end play, while allowing y-axis vertical adjustability. The veneer tie 52 is adjustable at the construction site to be set on within the bed joint 30 of a rubble stone 20 that is substantially horizontal and in accordance with building regulations and standards. To further enwrap and restrict x- and z-axis movement, as shown in FIG. 4, the interior of the receiving end 69 is flattened into a D-shape to further restrict the area within the receiving end 65.

Figure 5:
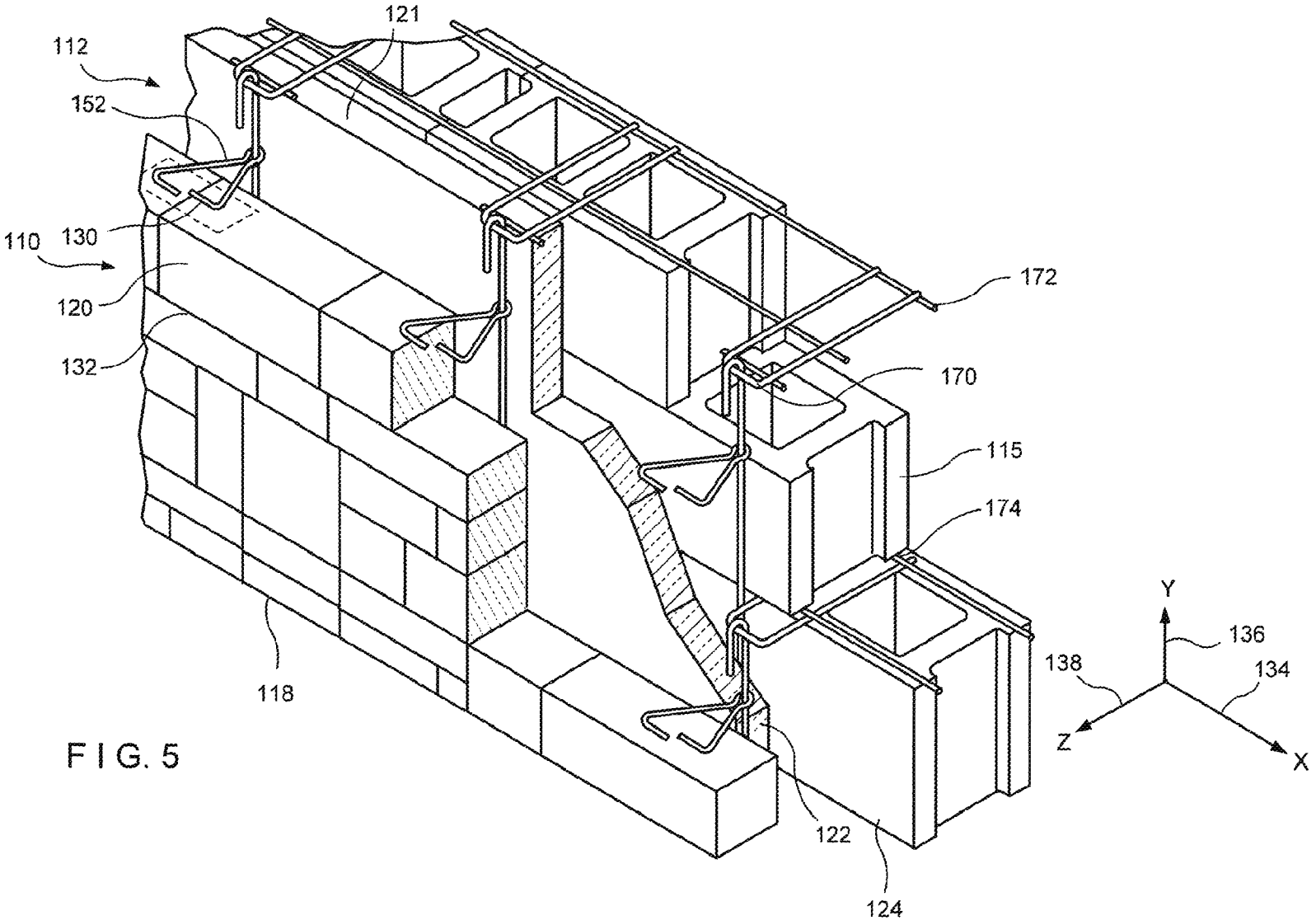
FIG. 5 shows a second embodiment of the rubble stone anchoring system of this invention and is a perspective view of the anchoring system partially constructed, set within an inner wythe of concrete masonry units with adjacent insulation and tied to an outer wythe of ashlar stone.
Figure 6:
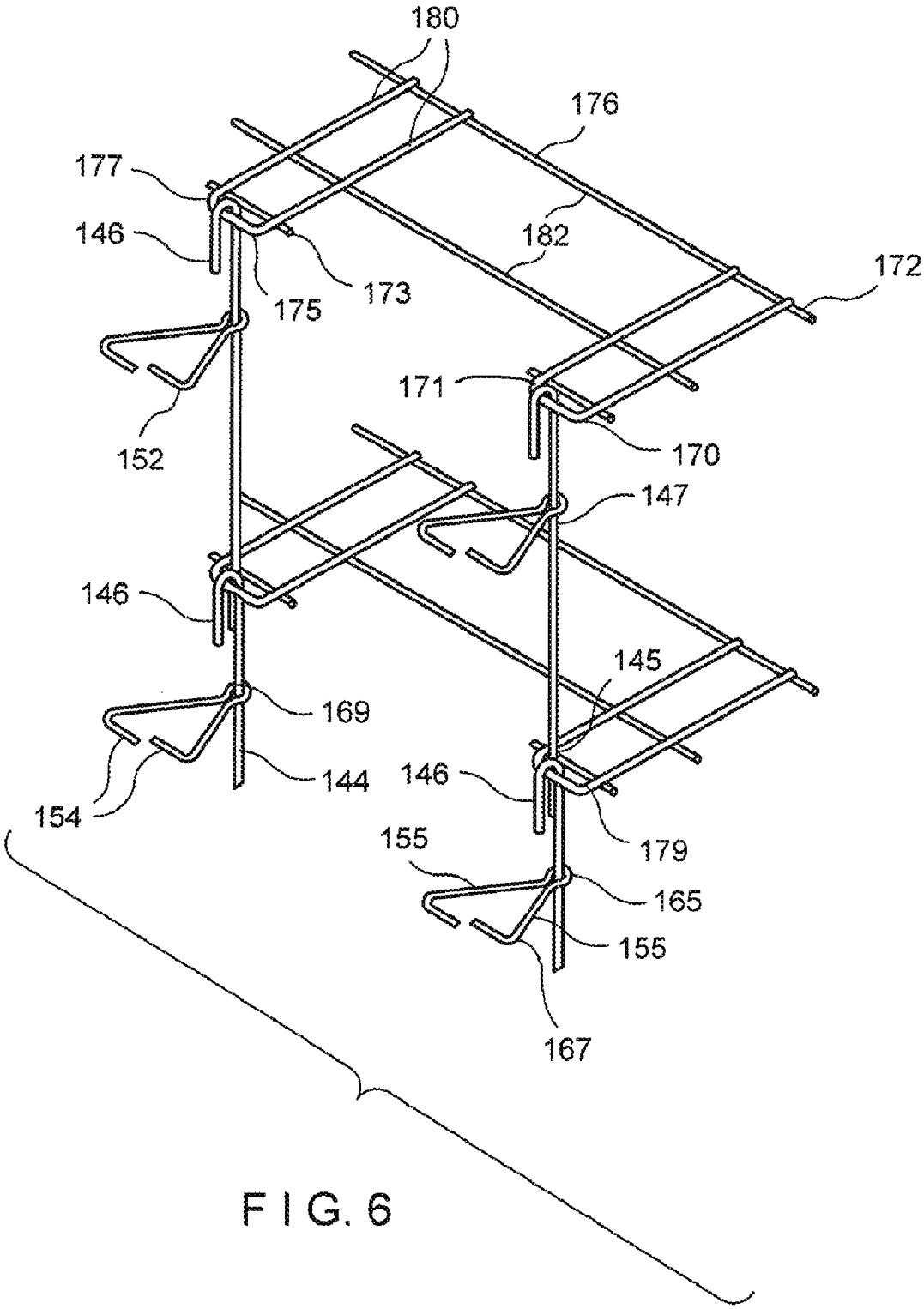
FIG. 6 is a perspective view of the uninstalled anchoring system of FIG. 5.
Figure 7:
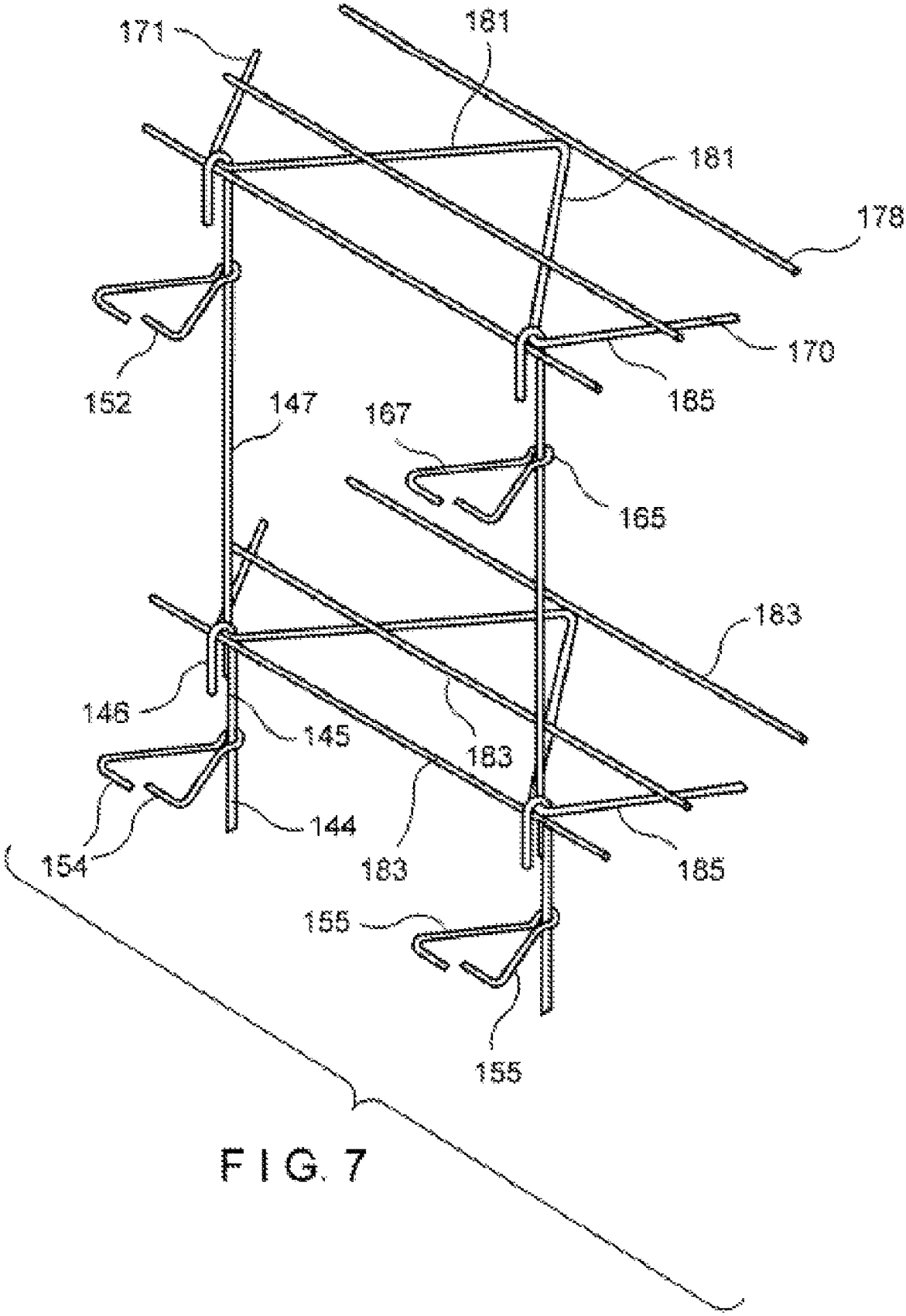
FIG. 7 is a perspective view of an alternative design anchoring system of this invention.

The description which follows is a second embodiment of the rubble stone anchoring system for cavity walls of this invention. For ease of comprehension, wherever possible, similar parts use reference designators 100 units higher than those above. Thus, a veneer tie 152 of the second embodiment is analogous to the veneer tie 52 of the first embodiment. Referring now to FIGS. 5 through 7, the second embodiment of the anchoring system for rubble stone is shown and is referred to generally by numeral 110.

As in the first embodiment, a cavity wall structure 112 is shown. In this embodiment, the cavity wall structure 112 has an inner wythe 115 formed from concrete masonry units. The cavity wall 112 also includes an outer wythe 118 of ashlar rubble stone construction. The anchoring system is also for use with a random rubble stone outer wythe (not shown). Between the inner wythe 115 and the outer wythe 118, a cavity 122 is formed. The cavity 122 contains a layer of insulation 121.

For purposes of discussion, the cavity surface 124 of the inner wythe 115 contains a horizontal line or x-axis 134 and an intersecting vertical line or y-axis 136. A horizontal line or z-axis 138, normal to the xy-plane, passes through the coordinate origin formed by the intersecting x- and y-axes.

The wall anchor 170 is shown as an extension of the reinforcement device 172 set within the bed joint 174 of the inner wythe 115. The reinforcement device is in the form of a ladder 176 or truss 178. When a ladder shaped reinforcement 176 is used in the formation of the anchor 170, the parallel intermediate rods 180, that connect the parallel side rods and maintain the parallelism of the side rods 182, extend beyond one of the side rods to form the anchor 170.

The anchor extension 171 portion is contiguous with said intermediate rods 180 and extends into the cavity 122. The anchor extension has two parallel ends 173 and 175 in the ladder configuration 176 that form a first receptor 177 for receiving the fitting or receiving end 146 of the connection bar or J-hook 144. The first receptor 177 is large enough for use as a second receptor 179 to fit both the fitting 146 of one J-hook 144 and the elongated body or connection end 145 of a second vertically planar J-hook 147. Securing both the elongated body 145 and the fitting 146 provides greater stability to the anchoring system. The wall anchor 170 is a wire formative constructed from galvanized steel, hot dipped galvanized steel, stainless steel or bright basic steel. The anchor 170 is set within the inner wythe 115 thereby creating a high-strength connection with the anchor 170 and the inner wythe 115.

The anchoring system includes the wall anchor 170 and a veneer tie 152. The veneer tie 152, is shown in FIG. 5 as being emplaced on the ashlar rubble stone 120 in preparation for embedment in the mortar of the bed joint 130. Successive bed joints 130 and 132 are horizontally disposed in an irregular manner in accord with the nature of the rubble stone 120 and building standards and the bed joint 130 and 132 are 0.375-inch (approx.) in height.

The veneer tie 152 is a wire formative that is fixedly disposed in an x-z plane of the bed joint 130 and is constructed to adjustably position with the longitudinal axis substantially horizontal and to interengage with the wall anchor 170. The veneer tie 152 has an apertured receiving end 165 for disposition on said elongated body 145 and an insertion end 167 configured for embedment in the bed joint 130. The veneer tie 152 is constructed of front leg portions 154 configured for insertion into said bed joint 130, side leg portions 155 coextensive, perpendicular, and substantially co-planar with the front leg portions 154. The veneer tie is vertically adjustable to a substantially horizontal position and upon installation, maintains continuous positive interengagement with the wall anchor 170. For additional seismic and high-wind protection, a reinforcement wire (not shown) is embedded in the bed joint 130 and set within an optionally depressed front leg portion (not shown) for a snap-in connection.

The veneer tie receiving end 165 is formed to snugly fit around the connection end 148 of the J-hook 144. The snug fit restricts x- and z-axis movement to 0.050 inches of end play, while allowing y-axis vertical adjustability. The veneer tie 152 is adjustable at the construction site to be set on within the bed joint 130 of a rubble stone 120 that is substantially horizontal and in accordance with building regulations and standards. To further enwrap and restrict x- and z-axis movement, as similarly shown in FIG. 4, the interior of the receiving end 169 is flattened into a D-shape to further restrict the area within the receiving end 165.

When a truss shaped reinforcement 178 is used, as shown in FIG. 7, in the formation of the anchor 170, the intermediate rods 181 are set at approximately 60 degree angles from the side rods 183 and connect the parallel side rods 183 and maintain the parallelism of the side rods 183. The intermediate rods 181 with the side rods 183 form a triangular shaped anchor 185. The connection bar 144 and veneer tie 152, as described above, for the ladder shaped reinforcement work in the same manner with the truss shaped reinforcement.

Figure 8:
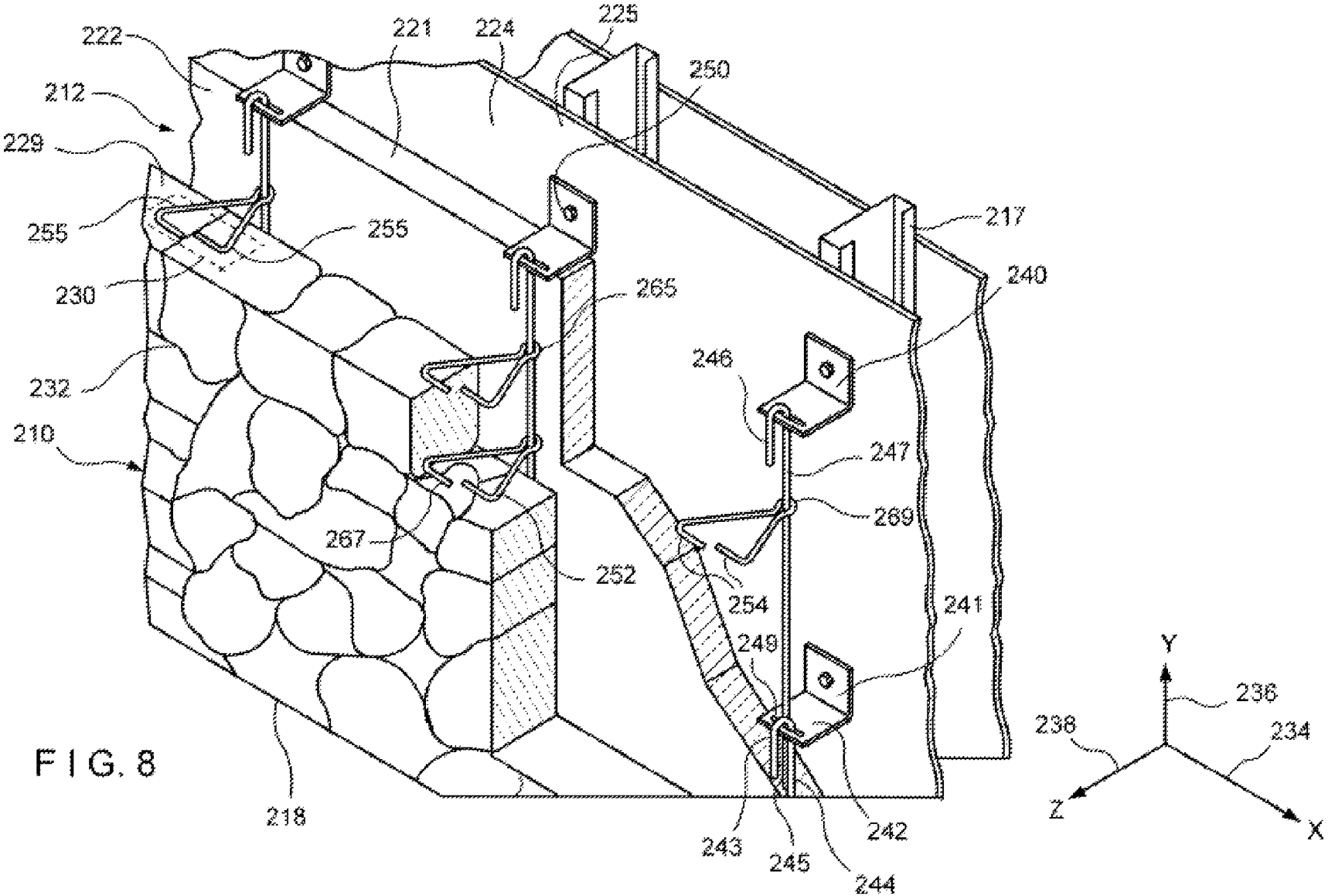
FIG. 8 shows a third embodiment of the rubble stone anchoring system of this invention and is a perspective view of the anchoring system partially constructed, fastened to a steel column inner wythe with attached dry wall with adjacent insulation and tied to an outer wythe of rough random rubble stone.

The description which follows is a third embodiment of the rubble stone anchoring system for cavity walls of this invention. For ease of comprehension, wherever possible, similar parts use reference designators 100 units higher than those of the second embodiment above. Thus, a veneer tie 152 of the second embodiment is analogous to the veneer tie 252 of the third embodiment. Referring now to FIG. 8, the third embodiment of the anchoring system for rubble stone is shown and is referred to generally by numeral 210.

As in the first embodiment, a cavity wall structure 212 is shown. In this embodiment, the cavity wall structure 212 has an inner wythe 217 formed from metal columns. The cavity wall 212 also includes an outer wythe 218 of random rubble stone construction. The anchoring system is also for use with a ashlar rubble stone outer wythe (not shown). Between the inner wythe 217 and the outer wythe 218, a cavity 222 is formed. The cavity 222 contains a layer of insulation 221.

For purposes of discussion, the cavity surface 224 of the drywall 225 set on the inner wythe 217 contains a horizontal line or x-axis 234 and an intersecting vertical line or y-axis 236. A horizontal line or z-axis 238, normal to the xy-plane, passes through the coordinate origin formed by the intersecting x- and y-axes.

The wall anchor 240 is shown as an L-shaped structure having a base portion 241 fastened to the inner wythe 217 and a free end portion 242 contiguous with and perpendicular to the base portion 241 and extending into the cavity 222 for connection with the fitting or receiving end 246 of the J-hook 244. The free end portion 242 has a first receptor 243 for connection with the connection bar or J-hook 244. The first receptor 243 is large enough for use as a second receptor 249 to fit both the fitting 246 of one J-hook 244 and the elongated body or connection end 245 of a second vertically planar J-hook 247. Securing both the elongated body 245 and the fitting 246 provides greater stability to the anchoring system. The wall anchor 240 is a metal stamping constructed from galvanized steel, hot dipped galvanized steel, stainless steel or bright basic steel. The wall anchor 240 is also mountable at a 90 degree angle (not shown).

The anchor 240 is fastened to the inner wythe 217 with a fastener 250 thereby creating a high-strength connection with the anchor 240 and the inner wythe 217. Although other fastening means are compatible, the fastener 250 is typically a bolt with a head with an insulative washer mounted under the bolt head. A thermal break is obtained through the use of a neoprene washer (not shown) between the fastener 250 and the inner wythe 217.

The anchoring system includes the wall anchor 240 and a veneer tie 252. The veneer tie 252, is shown in FIG. 8 as being emplaced on the random rubble stone 229 in preparation for embedment in the mortar of the bed joint 230. Successive bed joints 230 and 232 are horizontally disposed in an irregular manner in accord with the nature of the rubble stone 229 and building standards and the bed joints 230 and 232 are 0.375-inch (approx.) in height.

The veneer tie 252 is a wire formative that is fixedly disposed in an x-z plane of the bed joint 230 and is constructed to adjustably position with the longitudinal axis substantially horizontal and to interengage with the wall anchor 240. The veneer tie 252 has an apertured receiving end 265 for disposition on said elongated body 245 and an insertion end 267 configured for embedment in the bed joint 230. The veneer tie 252 is constructed of front leg portions 254 configured for insertion into said bed joint 230, side leg portions 255 coextensive, perpendicular, and substantially co-planar with the front leg portions 254. The veneer tie is vertically adjustable to a substantially horizontal position and upon installation, maintains continuous positive interengagement with the wall anchor 240. For additional seismic and high-wind protection, a reinforcement wire (not shown) is embedded in the bed joint 230 and set within an optionally depressed front leg portion (not shown) for a snap-in connection.

The veneer tie receiving end 265 is formed to snugly fit around the connection end 248 of the J-hook 244. The snug fit restricts x- and z-axis movement to 0.050 inches of end play, while allowing y-axis vertical adjustability. The veneer tie 252 is adjustable at the construction site to be set within the bed joint 230 of a rubble stone 220 that is substantially horizontal and in accordance with building regulations and standards. To further enwrap and restrict x- and z-axis movement, as similarly shown in FIG. 4, the interior of the receiving end 269 is flattened into a D-shape to further restrict the area within the receiving end 265.

The anchoring system for rubble stone set forth above solves the problems of the prior art by providing a solution to the uneven uncoursed nature of rubble stone outer wythes. The present invention described above provides a vertically adjustable veneer tie capable of adjusting to meet the irregular structure of rubble stone outer wythes, while providing the same stability as anchoring systems for standard bed joints. The anchoring system allows for veneer tie y-axis adjustment while restricting x- and z-axis movement, ensuring a stable tie back connection with the uneven nature of the rubble stone.

The rubble stone anchoring system described in the embodiments herein addresses issues unique to the art of anchoring irregular masonry veneers in an efficient and structurally stable manner. This invention resolves the structural issues related to the construction of a rubble stone outer wythe, by providing a vertically adjustable anchoring system capable of withstanding high lateral forces. This invention further reduces other costs and elements required to construct a cavity wall system.

The present invention is in response to the prior art labor and materials intensive rubble stone cavity wall construction. Construction of a cavity wall containing a rubble stone outer wythe involves careful installation of the veneer ties at appropriate levels and locations within the outer wythe. As shown in the above embodiments, the present invention addresses the difficulties through the use of a vertically adjustable anchoring system. In addition to rubble stone outer wythes, the present invention is utilized with standard brick veneer outer wythes.

Adjustments in the construction of the wall anchor to provide solutions to individual construction issues relating to rubble stone outer wythes are recognized and anticipated. Further, the particular embodiments set forth above are in no way limiting of possible variations to accommodate changes in the construction of the inner or outer wythe. It is intended that the claims cover such modifications that do not alter the scope of the present invention. Because many varying and different embodiments may be made within the scope of the inventive concept herein taught and because many modifications may be made in the embodiments herein detailed in accordance with the descriptive requirement of the law, it is to be understood that the details herein are to be interpreted as illustrative and not in a limiting sense.

What is claimed is:

1. An anchoring system for use in a wall having an inner wythe formed from successive courses of brick, block, stone or similar masonry building material, said courses having between each two adjacent courses a horizontal mortar joint of predetermined height, and an outer wythe in a spaced apart relationship with a cavity therebetween, said outer wythe formed from a plurality of rubble stones having a bed joint between adjacent rubble stones, said rubble stones having an irregular surface, said anchoring system comprising:

a wall anchor configured to be disposed within said inner wythe, said wall anchor, in turn, comprising:

a reinforcement device, said reinforcement device comprising:

a plurality of side rods parallel to one another;

at least one intermediate rod connecting said side rods and maintaining the parallelism of said side rods;

an extension portion contiguous with said intermediate rod, said extension portion forming a first receptor and extending into said cavity;

a connection bar having a fitting at one end thereof for interengaging said first receptor and an elongated body depending therefrom, and, upon interengagement with said first receptor said elongated body is disposed in said cavity, wherein said fitting is configured for loose interengagement with said first receptor, thereby permitting movement of said connection bar relative to said extension portion; and, a veneer tie for disposition on said connection bar, said veneer tie, in turn, comprising:

an aperture at one end thereof dimensioned for limiting lateral movement and front-to-back displacement; and an insertion end portion configured for embedment in said bed joint of said outer wythe;

whereby said veneer tie is limited to vertical alignment with said bed joint.

2. An anchoring system as described in claim 1, wherein said veneer tie is a wire formative.

3. An anchoring system as described in claim 2, wherein said veneer tie insertion end portion further comprises:

front leg portions configured for insertion into said bed joint of said outer wythe; and at least one side leg portion coextensive and substantially co-planar with said front leg portions and said apertured end.

4. An anchoring system as described in claim 2, wherein said veneer tie apertured end is formed to enwrap the connection bar elongated body thereby restricting lateral movement and front-to-back displacement.

5. An anchoring system as described in claim 4, wherein said veneer tie aperture end lateral movement is limited to 0.050 inches and said veneer tie apertured end front-to-back displacement is limited to 0.050 inches.

6. An anchoring system as described in claim 1, wherein said anchoring system further comprises:

a second wall anchor configured to be disposed on said inner wythe, said second wall anchor, in turn, comprising:

a second reinforcement device, said second reinforcement device comprising:

a plurality of side rods parallel to one another;

at least one intermediate rod connecting said side rods and maintaining the parallelism of said side rods;

an extension portion contiguous with said intermediate rod, said extension portion forming a second receptor and extending into said cavity;

whereby said elongated body of said connection bar is disposed within said first receptor and said second receptor thereby securing said connection bar within said cavity.

7. An anchoring system as described in claim 1, wherein the veneer tie comprises a front portion having opposite ends and configured for insertion into a bed joint of the outer wythe, side leg portions extending from respective opposite ends of the front portion and generally converging with each other at a convergence location, the front portion and side leg portions from the front portion ends to the convergence location generally forming a triangle, and a receiving end on a side of the convergence location opposite the front portion, the receiving end having a closed loop shape for receiving a portion of the anchoring system therein.

8. An anchoring system as described in claim 7 wherein the front portion, side leg portions and receiving end of the veneer tie are formed as one piece of material.

9. An anchoring system as described in claim 8 wherein the front portion, side leg portions and receiving end of the veneer tie are formed from a single piece of wire.

10. An anchoring system as described in claim 8 wherein the receiving end of the veneer tie is formed by an extension of the side leg portions from the convergence location.

11. An anchoring system as described in claim 7 wherein the front portion of the veneer tie comprises front leg portions.

12. An anchoring system as described in claim 11 wherein the front leg portions of the veneer tie have free ends.

13. An anchoring system as described in claim 12 wherein the free ends of the front leg portions of the veneer tie are non-coaxial and offset from each other.

14. An anchoring system as described in claim 13 wherein the front leg portions of the veneer tie are generally co-planar.

15. An anchoring system as described in claim 1, wherein the fitting of the connection bar is a J-hook fitting.

16. An anchoring system as described in claim 1, wherein the intermediate rod extends beyond one of the side rods and into the cavity to form the extension portion.

* * * * *